US010343868B2

(12) United States Patent
Liang et al.

(10) Patent No.: US 10,343,868 B2
(45) Date of Patent: Jul. 9, 2019

(54) ROLLER WITH PRESSURE SENSOR AND R TO R DEVICE

(71) Applicant: Industrial Technology Research Institute, Hsinchu (TW)

(72) Inventors: Ming-Kaan Liang, Hsinchu (TW); Ming-Ji Dai, Hsinchu (TW); Chin-Hung Wang, Hsinchu (TW); Chih-Ming Shen, New Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 292 days.

(21) Appl. No.: 15/220,958

(22) Filed: Jul. 27, 2016

(65) Prior Publication Data

US 2018/0022563 A1 Jan. 25, 2018

(30) Foreign Application Priority Data

Jul. 25, 2016 (TW) ..... 105123392 A

(51) Int. Cl.

| | |
|---|---|
| ***B65H 27/00*** | (2006.01) |
| ***B65H 23/188*** | (2006.01) |
| ***B65H 23/04*** | (2006.01) |
| ***B65H 23/192*** | (2006.01) |

(52) U.S. Cl.

CPC ..... *B65H 23/1888* (2013.01); *B65H 23/044* (2013.01); *B65H 23/192* (2013.01); *B65H 27/00* (2013.01); *B65H 2408/2171* (2013.01); *B65H 2515/30* (2013.01); *B65H 2515/31* (2013.01); *B65H 2515/312* (2013.01); *B65H 2553/26* (2013.01)

(58) Field of Classification Search

CPC ... B65H 27/00; B65H 23/044; B65H 23/1888

See application file for complete search history.

(56) References Cited

U.S. PATENT DOCUMENTS

| | | | | |
|---|---|---|---|---|
| 4,784,577 | A | 11/1988 | Ritson et al. | |
| 5,155,444 | A | 10/1992 | Green et al. | |
| 5,383,371 | A * | 1/1995 | Laitinen | D21F 3/06 73/862.55 |
| 6,105,895 | A | 8/2000 | Schmodde et al. | |
| 7,183,764 | B2 | 2/2007 | Goldfine et al. | |
| 7,444,862 | B2 | 11/2008 | Innala et al. | |
| 9,121,136 | B2 * | 9/2015 | Aengeneyndt | G01K 1/026 |

(Continued)

FOREIGN PATENT DOCUMENTS

| | | |
|---|---|---|
| TW | 200418708 | 10/2004 |
| TW | I386356 | 2/2013 |

(Continued)

OTHER PUBLICATIONS

Taiwan Patent Office, Office Action, Patent Application Serial No. 105123392, dated Oct. 6. 2017, Taiwan.

*Primary Examiner* — Sang K Kim

(57) ABSTRACT

Provided is a roller with pressure sensor. The roller includes a pressure sensor mounted to the roller. The pressure sensor includes a plurality of pressure sensing units distributed on a thin film. The pressure sensing units are electrically connected to each other with a metal wire but not in contact with each other. Also provided is a roll-to-roll device, which includes a roller mechanism and a pressure sensor.

9 Claims, 8 Drawing Sheets

(56) References Cited

U.S. PATENT DOCUMENTS

| | | | | |
|---|---|---|---|---|
| 2005/0077643 | A1 | 4/2005 | Matsuoka | |
| 2005/0278135 | A1* | 12/2005 | Murphy | G01K 1/00 702/130 |
| 2006/0020418 | A1* | 1/2006 | Moore | B41F 13/24 702/170 |
| 2007/0163318 | A1* | 7/2007 | Mucke | B21B 38/02 72/9.1 |
| 2011/0226070 | A1* | 9/2011 | Berendes | G01L 5/0085 73/862.55 |
| 2011/0301003 | A1* | 12/2011 | Gustafson | D21F 3/06 492/10 |
| 2014/0257719 | A1* | 9/2014 | Figiel | D21F 3/06 702/41 |

FOREIGN PATENT DOCUMENTS

| | | |
|---|---|---|
| TW | 201404606 | 2/2014 |
| TW | I472470 | 2/2015 |
| TW | I519463 | 2/2016 |
| TW | 201625363 | 7/2016 |

* cited by examiner

ROLLER WITH PRESSURE SENSOR AND R TO R DEVICE

CROSS REFERENCE TO RELATED APPLICATIONS

This application claims the priority benefits of Taiwan application serial No. 105123392, filed on Jul. 25, 2016, the entirety of which is incorporated by reference herein.

TECHNICAL FIELD

The disclosure relates to a roller with pressure sensor and a roll-to-roll device.

BACKGROUND

A roll-to-roll device could adopt a process of controlling a reel by the gravitational force to alleviate the non-uniform tension. In addition to detection of variation of tension, the roll-to-roll device still requires to monitor and regulate the detection of speed variation, during a process of transferring a film. Under a normal operation, when an automatic unwinding and tension monitoring module is activated, it cooperates with a winding module at the rear end for performing a transfer process. In the transfer process, regulating the non-uniform tension could be performed because of the difference of speed control between the front and the rear ends. When a steady state for the regulating is reached, the entire line for the transfer process can perform the transferring synchronously. For transferring an ultrathin glass substrate, sensors that are arranged in a load cell under a roller can be used to detect tension and speed so as to identify if a breaking or a cracking occurs in the substrate during the transfer process.

A conventional roll-to-roll device comprises a winding/unwinding mechanism, a buffering mechanism, a cushioning mechanism, an edge-following positioning mechanism, and a full-hood high-efficiency particulate air (HEPA) filter unit. The winding/unwinding mechanism uses a servomotor in cooperation with the load cell, to control the tension of the material roll. The buffering mechanism keeps manufacturing by a way of non-stop. The cushioning mechanism peels a film of a substrate and can be used, flexibly, in various production processes. The edge-following positioning mechanism involves an edge position control (E.P.C.) system to achieve neat and regular winding. The full-hood HEPA filter unit helps to maximize purity and cleanness.

SUMMARY

The disclosure provides an embodiment of a roller with pressure sensor, wherein a pressure sensor is attached to the roller and the pressure sensor comprises a plurality of pressure sensing units distributed on a thin film such that the pressure sensing units are electrically connected but not in contact with each other.

The disclosure provides an embodiment of a roll-to-roll device, which at least comprises a roller mechanism, the roller mechanism comprising an unwinding roller, a first intermediate roller, a second intermediate roller, a third intermediate roller, and a winding roller; and a pressure sensor being mounted to each of the first intermediate roller, the second intermediate roller, and the third intermediate roller.

The disclosure provides another embodiment of the roll-to-roll device. In the embodiment, the roll roll-to-roll device comprises a chassis, which comprises a longitudinal chassis and a transverse chassis; an unwinding unit; a plurality of intermediate rollers, which comprises a first upper intermediate roller, a first lower intermediate roller, a second upper intermediate roller, a second lower intermediate roller, and a third upper intermediate roller; and a winding unit, wherein the unwinding unit, a front dual-clamping roller, the plurality of intermediate rollers, a rear dual-clamping roller, and a winding unit are mounted on the chassis such that the first upper intermediate roller, the second upper intermediate roller, and the third upper intermediate roller are mounted to the transverse chassis, and the first lower intermediate roller and the second lower intermediate roller are mounted to the longitudinal chassis; wherein the unwinding unit and the winding unit are respectively arranged on a front side and a rear side of the chassis, the front dual-clamping roller is arranged between the unwinding unit and the first upper intermediate roller, and the rear dual-clamping roller is arranged between the winding unit and the third upper intermediate roller; and wherein the unwinding unit forwards a thin substrate unwound from a material roll through a front dual-clamping roller, allowing the thin substrate to pass through the first upper intermediate roller, and then pass through the first lower intermediate roller, the second upper intermediate roller, the second lower intermediate roller, and the third upper intermediate roller, and then the thin substrate is sent out by the rear dual-clamping roller for being wound by the winding device.

The foregoing will become better understood from a careful reading of a detailed description provided herein below with appropriate reference to the accompanying drawings.

DETAILED DESCRIPTIONS

Figure 1A:
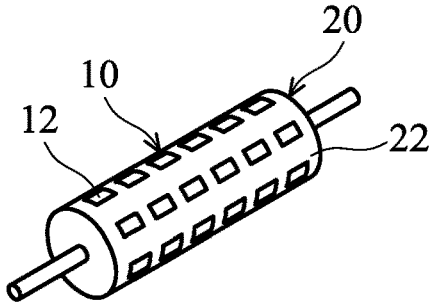
FIGS. 1A, 1B, 1C, and 1D are schematic views respectively illustrating various examples of a roller with pressure sensor according to embodiments of the disclosure.

Below, exemplary embodiments will be described in detail with reference to accompanying drawings to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

Figure 1B:
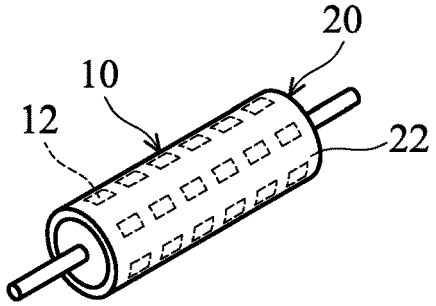
Figure 1C:
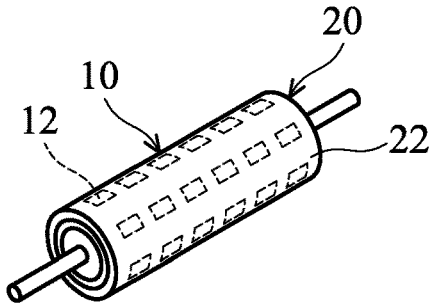
Figure 1D:
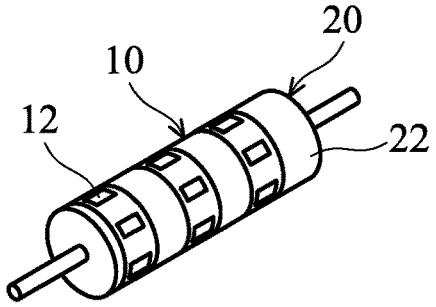

Referring to FIGS. 1A, 1B, 1C, and 1D, which are schematic views respectively illustrating various examples of a roller with pressure sensor according to embodiments of the disclosure. The disclosure is applicable to a roll-to-roll device or any other suitable roller mechanisms, such as a roller 20 including a pressure sensor 10 or a roller 20 including a real-time pressure sensor 10. In an embodiment, the pressure sensor 10 comprises a plurality of pressure sensing units 12. The plurality of pressure sensing units 12 are distributed, in a form of an array, on a thin film (not shown) such that the pressure sensing units 12 are electrically connected to each other but not in contact with each other. The thin film may be structured to include upper and lower layers between which the plurality of pressure sensing units 12 are arranged as an array. The pressure sensing units 12 may be in a form of a plate having a shape of for example a square, a rectangle, or a strip. The pressure sensor 10 is a flexible pressure sensor or a real-time pressure sensor. The pressure sensor 10 may be attached to a surface 22 of the roller 20, as shown in FIG. 1A, or alternatively arranged inside the roller 20, as shown in FIG. 1B, or alternatively mounted to an internal wall of the roller 20, as shown in FIG. 1C.

In another embodiment, the pressure sensor 10 may be alternatively arranged as a plurality of strip-shaped pressure sensors circumferentially arranged on the surface 22 of the roller 20.

In an embodiment, the roller 20 may be of a hollow structure or a non-hollow structure. Thus, the pressure sensor 10 may be mounted to an internal wall of the roller 20 at a location close to the surface 22 of the roller 20 in order to conduct a detection in a range engageable with a thin substrate 30. Thus, with such an arrangement, sensitivity of the detection of the pressure sensor 10 may be ensured.

Figure 4:
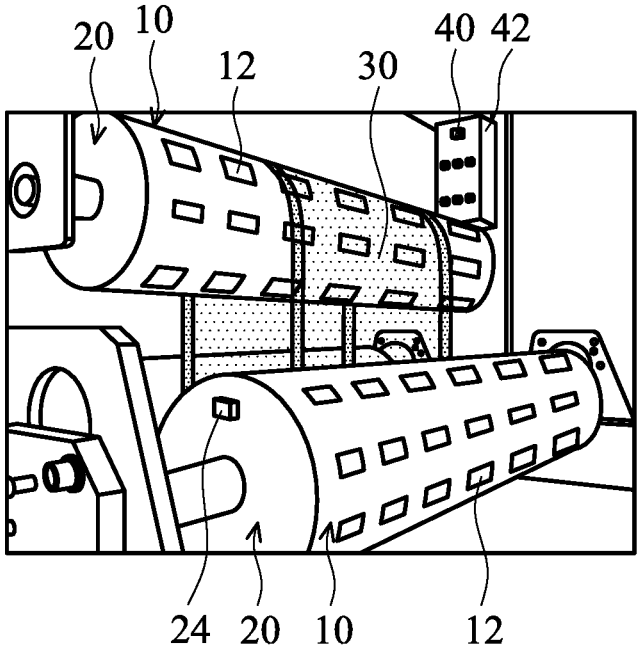
FIG. 4 is a schematic view illustrating the signal transmission conducted by the roller with pressure sensor according to an embodiment of the disclosure.

In an embodiment, the plurality of pressure sensing units 12 of the pressure sensor 10 may be arranged in an array and are electrically connected to each other by means of for example metal wires. And, a micro integrated circuit (IC) and a signal transmitter are arranged at an end of the pressure sensor 10, as shown in FIG. 4. In another embodiment, the pressure sensing units 12 may be arranged in an irregular way.

Figure 2A:
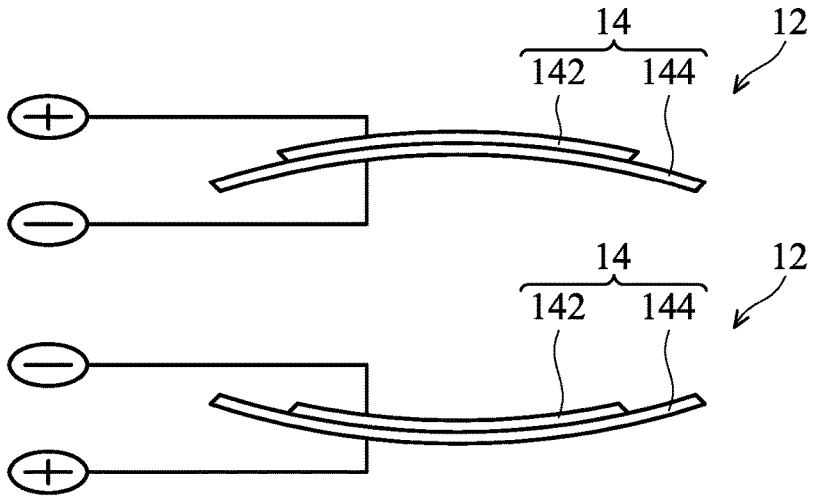
FIGS. 2A and 2B are schematic views illustrating an operation of a plurality of pressure sensing units of a pressure sensor according to an embodiment of the disclosure.
Figure 2B:
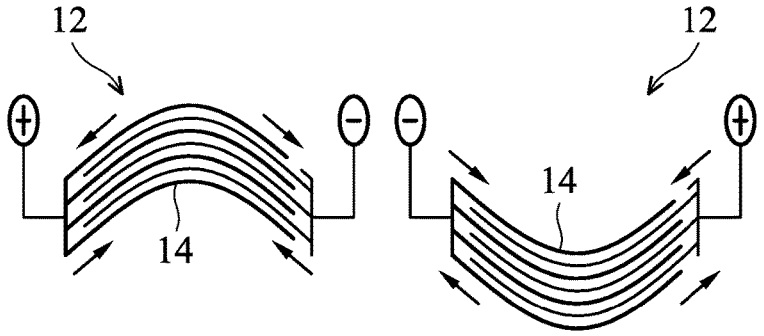

Referring to FIGS. 2A and 2B, which are schematic views illustrating an operation of the pressure sensing units of the pressure sensor according to an embodiment of the disclosure. Each of the pressure sensing units 12 may involve a vibration membrane 14, and the vibration membrane 14 comprises a piezoelectric plate 142 attached to a metal plate 144. The piezoelectric plate 142 may comprise multiple layers of ceramic piezoelectric sheets. In an embodiment, when a voltage applied to the metal plate 144 is negative and that of the piezoelectric plate 142 is positive, then the piezoelectric plate 142 expands and the metal plate 144 expands in unison so that the vibration membrane 14 warps or curves upwards to show condition (a) illustrated in FIG. 2A. When a voltage applied to the piezoelectric plate 142 is negative and that of the metal plate 144 is positive, then the piezoelectric plate 142 contracts and the metal plate 144 contracts in unison so that the vibration membrane 14 warps or curves downwards to show condition (b) illustrated in FIG. 2A. As shown in FIG. 2B, when a multiple-layer vibration membrane 14 is applied with a voltage that alternately changes, the vibration membrane 14 follows the changes of the voltage to curves upwards or downwards. Thus, the pressure sensing unit 12 is touched and a change of voltage is triggered, the vibration membrane 14 varies to thereby issue a signal for notifying an abnormality.

In an embodiment, the vibration membrane 14 of the disclosure may be a piezoelectric sensor or a resistive pressure sensor, or a capacitive pressure sensor; however, the scope of the disclosure is not limited thereto.

In an embodiment, the vibration membrane 14 has a piezoelectric coefficient $D_{33}$, which, for ceramics, is 500 pico-coulomb/newton (PC/N, $10^{-9}$ coulomb/newton) and, for polyvinylidene fluoride (PVDF), is 18-32 PC/N.

Figure 3:
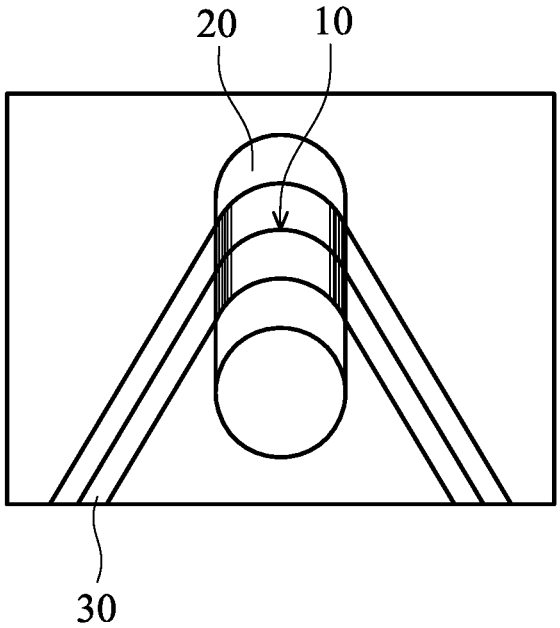
FIG. 3 is a schematic view illustrating the sensing conducted by the roller with pressure sensor according to an embodiment of the disclosure.

Referring to FIG. 3, which is a schematic view illustrating sensing conducted by the roller with pressure sensor according to an embodiment of the disclosure, as the roller 20 and the pressure sensor 10 shown in FIG. 1A. When a thin substrate 30 is attached on the roller 20, and it is also attached on the pressure sensor 10 and the pressure sensing units 12, the tension of a surface of the thin substrate 30 that contacts with the roller 20 must be uniformly distributed, so that transferring the thin substrate 30 may be stable. Oppositely, in case that the tension of the surface is not uniformly distributed in the thin substrate 30, different tensions may be produced in two sides of the roller 20, therefore, the pressure sensing units 12 will issue an abnormality signal to inform the thin substrate 30 of occurring a problematic transfer when the pressure sensing units 12 are affected by the non-uniform tension. The inform scheme may be implemented by an alarm light, an alarm sound, or a numeric abnormality notification.

Referring to FIG. 4, which is a schematic view illustrating the signal transmission conducted by the roller with pressure sensor according to an embodiment of the disclosure, when a problem of non-uniform distribution of pressure occurs in the thin substrate 30 during the transfer process of the thin substrate 30, a signal transmitter 24 (mounted to a flexible circuit board) of the pressure sensor 10 transmits a pressure non-uniformity signal, in a real-time manner, to a signal receiver 42 (mounted to another circuit board, which may be, for example, arranged inside a controller 40) to be received thereby for issuing an alarm signal. In an embodiment, causing the problem occurring in the transfer process may include tension of the thin substrate 30, speeds of the front and the rear rollers, dust particles, location of the thin substrate, tightness of the thin substrate, and so on. The signal transmitter 24 and the signal receiver 42 are known devices and no description will be given herein. In an embodiment, alarm devices or methods are provided to respectively correspond to the tension of the thin substrate, the speeds of the front and the rear rollers, dust particles, the location of the thin substrate, and the tightness of the thin substrate, and these alarm devices or methods may be alarm lights, alarm sounds, or by using a numerical abnormality notification.

A tightness problem of the thin substrate 30 may cause abnormality of transferring the thin substrate 30 and abnormal winding of the roller 20. Thus, in an embodiment, when the pressure sensing units 12 are affected by over-tightness or under-tightness of the thin substrate 30, an abnormality signal is issued to indicate there is a tightness problem occurring in the thin substrate 30 and it is needed to adjust a spacing distance between two rollers 20. Details will be provided below.

In an embodiment, it may be arranged to completely wrap the pressure sensor 10 around the roller 20, so that when the thin substrate 30 is moved on the roller 20, the voltage distribution on the thin substrate 30 can be detected, thereby to identifying the pressure distribution on the thin substrate 30. Therefore, a voltage signal is transmitted to the controller 40 for controlling a motor to adjust the rollers 20 to uniformly transfer the thin substrate 30. Also, knowing the pressure of the rollers 20 may adjust the rollers 20 of each manufacturing line such that an entire manufacturing can be conducted in a smooth, accurate, and efficient manner.

Accordingly, the embodiments of the disclosure may detect the pressure distribution, while the known pressure sensors using load cell do not detect the pressure distribution. Thus, the embodiments of the disclosure help to improve a transfer efficiency of a thin substrate and allow for continuously monitoring and detecting the transfer process of the thin substrate.

Figure 5:
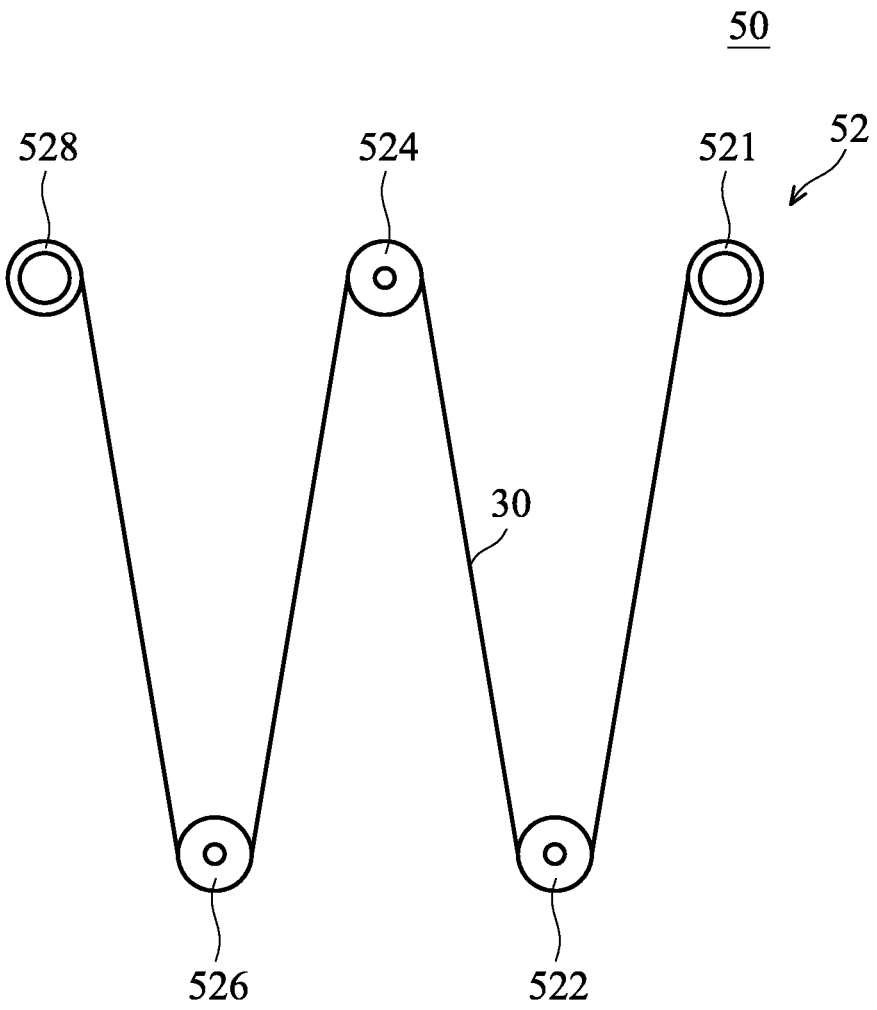
FIG. 5 is a schematic view illustrating a roller mechanism of a roll-to-roll device according to an embodiment of the disclosure.

Referring to FIG. 5, which is a schematic view illustrating a roller mechanism of a roll-to-roll device according to an embodiment of the disclosure, this embodiment is provided as an illustrative example but the scope of the disclosure is not limited thereto. In the embodiment, the roll-to-roll device 50 comprises a roller mechanism 52, and the roller mechanism 52 comprises an unwinding roller 521, a first intermediate roller 522, a second intermediate roller 524, a third intermediate roller 526, and a winding roller 528. The unwinding roller 521 releases and unwinds the thin substrate 30 therefrom to pass through the first intermediate roller 522, the second intermediate roller 524, and the third intermediate roller 526, so as to allow the thin substrate 30 to be wound up by the winding roller 528. The pressure sensor 10 is mounted to each of the first intermediate roller 522, the second intermediate roller 524, and the third intermediate roller 526. Thus, the first intermediate roller 522, the second intermediate roller 524, and the third intermediate roller 526 may respectively detect the tensions of the thin substrate 30 passing through the first intermediate roller 522, the second intermediate roller 524, and the third intermediate roller 526, speeds of the rollers, and a level of tightness of the thin substrate. When abnormality occurs, with the thin substrate 30 being moved on the roller 20, voltage distribution of the thin substrate 30 can be detected, thereby identifying the pressure distribution on the thin substrate 30. Therefore, a voltage signal is transmitted to the controller 40 for controlling the motor to adjust the roller 20, making the transferring of the thin substrate 30 consistent and uniform. In an embodiment, there may be one single intermediate roller or a plurality of intermediate rollers, this being dependent upon actual requirements.

In an embodiment, the roll-to-roll device of the disclosure may further comprise a cushioning mechanism, a buffering mechanism, an edge-following positioning mechanism, and a full-hood HEPA filter unit (not shown in the drawings). Details will not be provided herein.

Figure 6:
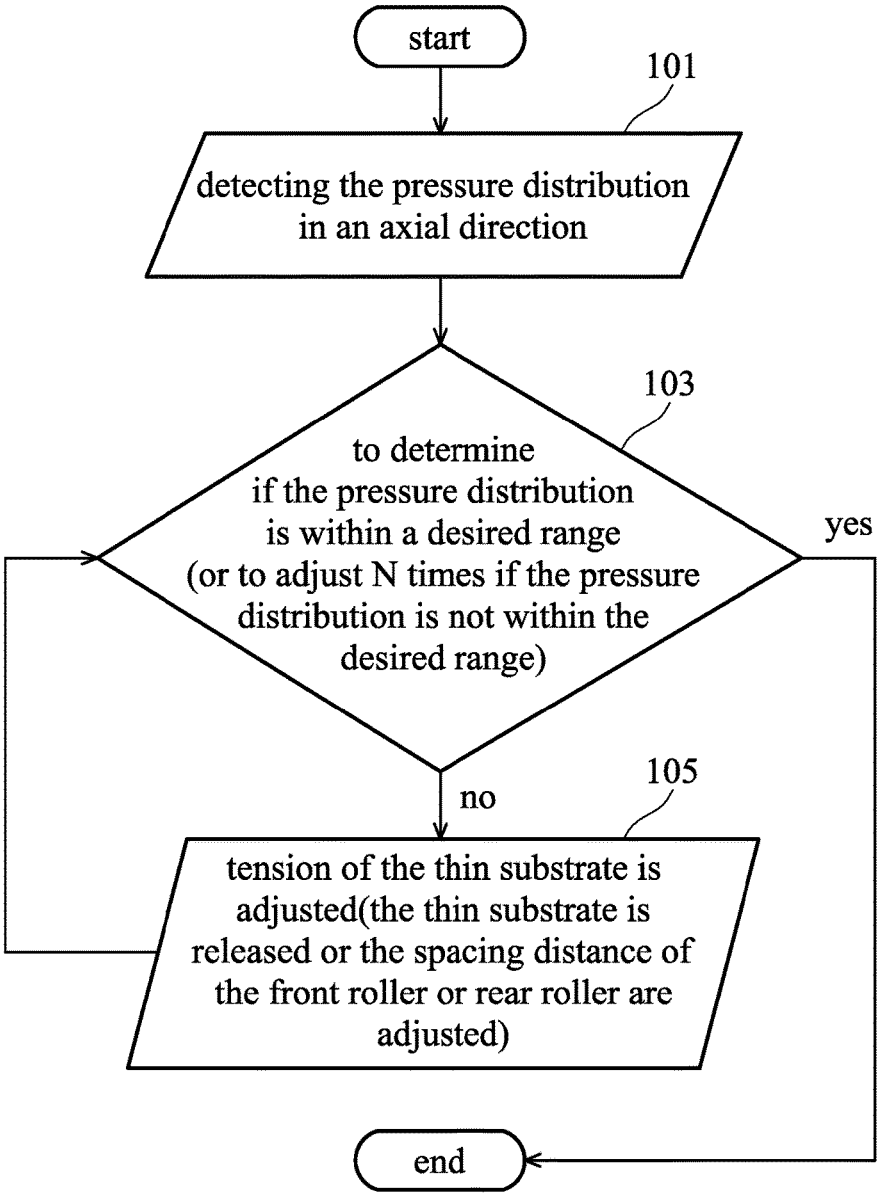
FIG. 6 is a flow chart illustrating a process of the roller with pressure sensor according to an embodiment of the disclosure.

Referring to FIG. 6, which is a flow chart illustrating a process of the roller with pressure sensor according to an embodiment of the disclosure, the flow chart in the embodiment first includes detecting the pressure distribution in an axial direction, this being Step 101. A central bar shown in FIG. 3 is the axial line of pressure. Since the pressure sensor 10 (the pressure sensing units 12) of the roller 20 may detect axial pressure distribution of the roller 20, Step 103 is conducted to determine if the pressure distribution is within a desired range, for example the pressure distribution being less than 10%. If it is not within the desired range, then the process goes to Step 105, where the tension of the thin substrate is adjusted, or the speeds or the spacing distance of the front roller and the rear roller are adjusted, or the location of the thin substrate is adjusted, or the level of tightness of the thin substrate is adjusted, or the dust particles are removed, according to the problems occurring, such as the tension of the thin substrate 30, the speeds of the front roller and the rear roller 20, dust particles, the location of the thin film, and the level of tightness of the thin film. Afterwards, a check is conducted to determine if it is within the desired range. When the check is within the desired range, the process is terminated and Step 101 is re-started. The adjustment of the spacing distance of the two rollers 20 may comprise adjusting the spacing distances of the unwinding roller, the intermediate roller(s), and the winding roller.

Figure 7:
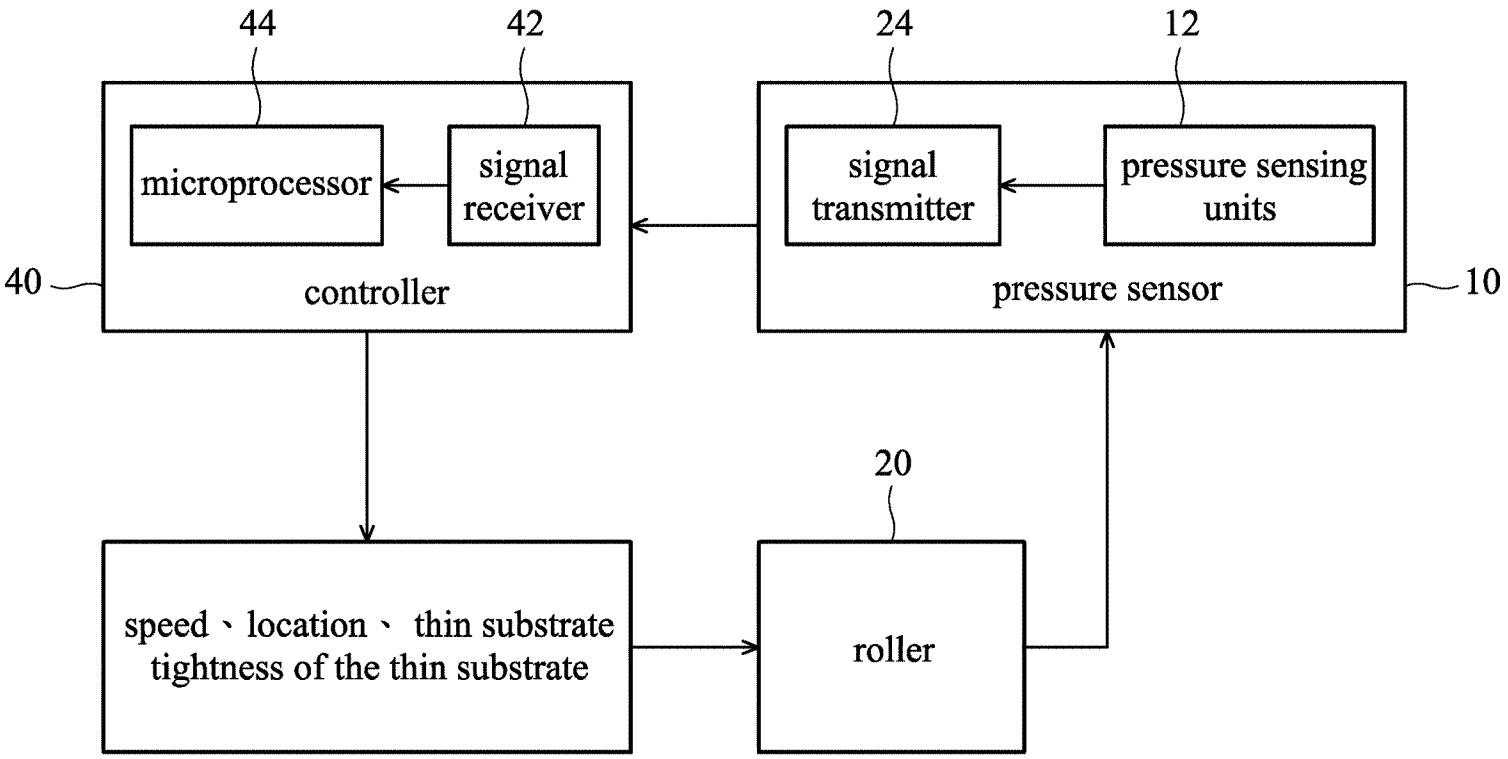
FIG. 7 is a schematic view illustrating the control of the roller with pressure sensor according to an embodiment of the disclosure.

Referring to FIG. 7, which is a schematic view illustrating the control of the roller with pressure sensor according to an embodiment of the disclosure, when the pressure sensing units 12 of the pressure sensor 10 mounted on the roller 20 are affected by the non-uniform distribution of pressure, the signal transmitter 24 transmits a signal to the signal receiver 42 of the controller 40. After the signal is to be processed by a microprocessor 44 of the controller 40, and the microprocessor 44 determines that the factors, such as the tension of the thin substrate 30, speeds of the front roller and the rear roller 20, dust particles, the location of the thin substrate, and the level of tightness of the thin substrate, affect the non-uniform distribution of pressure, a control signal is issued to adjust, for example, the tension of the thin substrate 30, the speeds of the front roller and the rear roller 20, dust particles, the location of the thin substrate, and the level of tightness of the thin substrate, for overcoming the problem of the non-uniform distribution of pressure.

In an embodiment, in case that a problem of for example the tightness of the thin substrate 30 or the speed of the roller 20 occurs, then improvement may be made by adjusting the spacing distance or the speed of the roller 20.

In an embodiment, in case that the tension of the thin substrate 30 is not uniform, the location of the thin substrate is incorrect, or there are dust particles, then the device must be shut down for adjusting and improving the factors.

Figure 8:
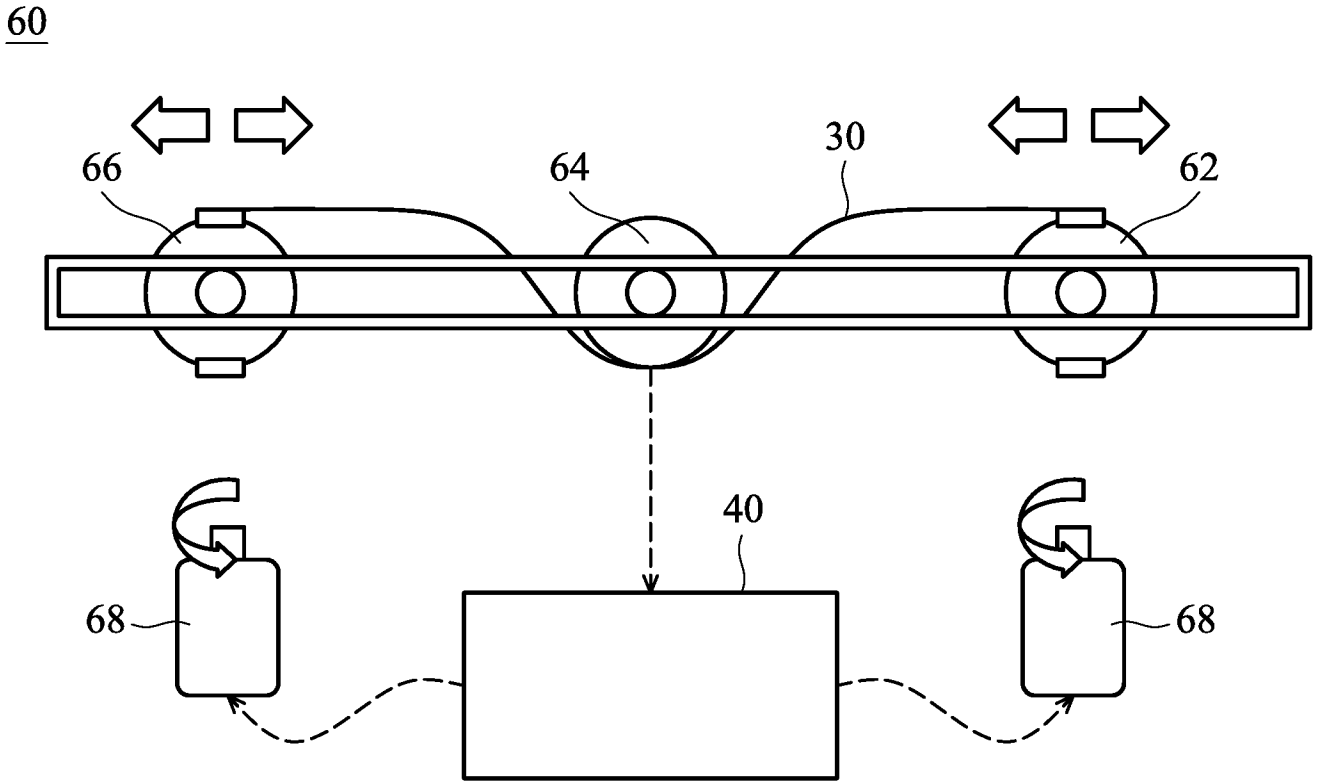
FIG. 8 is a schematic view illustrating regulation of a roller mechanism involving the roller with pressure sensor according to an embodiment of the disclosure.

Referring to FIG. 8, which is a schematic view illustrating regulation or adjustment of a roller mechanism that involves the roller with pressure sensor according to an embodiment of the disclosure, the adjustment of the roller mechanism of the embodiment provided herein is an illustrative example and the scope of the disclosure is not limited to the structure of such a roller mechanism and is also applicable to other roller mechanism, the instant illustrative example being provided for reference and illustration only.

A roller mechanism 60 comprises an unwinding roller 62, an intermediate roller 64, and a winding roller 66. The pressure sensor 10 is mounted to the intermediate roller 64. The thin substrate 30 is unwound and released from the unwinding roller 62, and after passing through the intermediate roller 64, the thin substrate 30 is wound up by the winding roller 66. Thus, when a problem of the tightness of the thin substrate 30 or the speed of the roller 20 occurs, through an operation of motors 68 to adjust the spacing distance between the unwinding roller 62 and the winding roller 66 or to adjust the speed of the unwinding roller 62 or the winding roller 66, the problem of the tightness of the thin substrate 30 or the speed of the roller can be overcome. The motors 68 are respectively controlled by signals issued from the controller 40.

Figure 9:
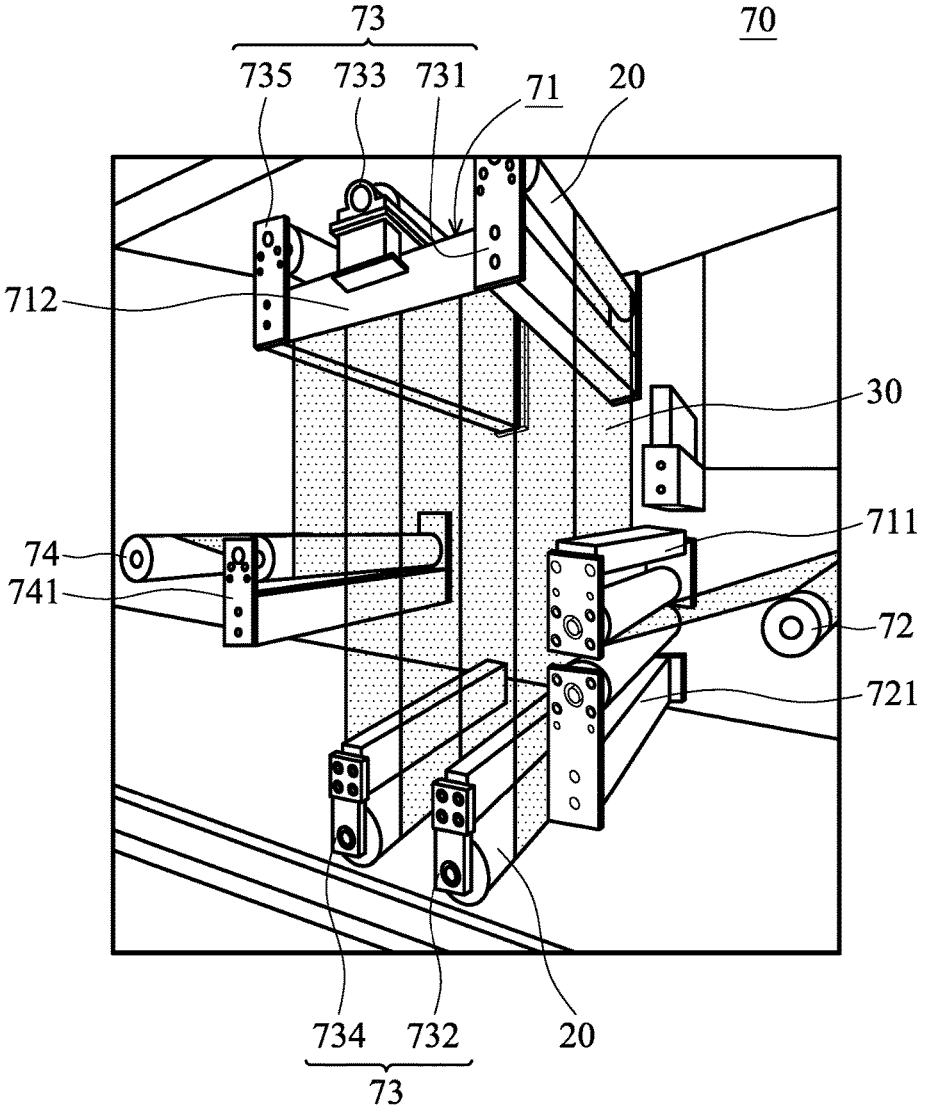
FIG. 9 is a schematic view illustrating a roll-to-roll device according to an exemplary embodiment of the disclosure.

Referring to FIG. 9, which is a schematic view illustrating a roll-to-roll device according to an exemplary embodiment of the disclosure, a roll-to-roll device 70 is provided in the exemplary embodiment, which comprises a chassis 71, an unwinding unit 72, a plurality of intermediate rollers 73, and a winding unit 74. The unwinding unit 74 is operable to forward a thin substrate 30 that is unwound and released from a material roll through a front dual-clamping roller 721 to allow the thin substrate 30 to pass through a first upper intermediate roller 731, and then pass through a first lower intermediate roller 732, a second upper intermediate roller 733, a second lower intermediate roller 734, and a third upper intermediate roller 735. Then, a rear dual-clamping roller 741 forwards the thin substrate 30 to the winding unit 74 to wind up the thin substrate 30. The roll-to-roll device comprises a mechanism. The mechanism comprises the unwinding unit 72, the front dual-clamping roller 721, the plurality of intermediate rollers 73, the rear dual-clamping roller 741 and the winding unit 74, which are mounted on the chassis 71. The chassis 71 comprises a longitudinal chassis 711 and a transverse chassis 712, wherein the first upper intermediate roller 731 and the second upper intermediate roller 733 and the third upper intermediate roller 735 are mounted on the transverse chassis 712, while the first lower intermediate roller 732 and the second lower intermediate roller 734 are mounted on the longitudinal chassis 711. The unwinding unit 72 and the winding unit 74 are separately arranged on front and rear sides of the chassis 71. The front dual-clamping roller 721 is arranged between the unwinding unit 72 and the first upper intermediate roller 731 and the rear dual-clamping roller 741 is arranged between the winding unit 74 and the third upper intermediate roller 735.

In an embodiment, the front dual-clamping roller 721, the first upper intermediate roller 731, the first lower intermediate roller 732, the second upper intermediate roller 733, the second lower intermediate roller 734, the third upper intermediate roller 735, and the rear dual-clamping roller 741 may be controlled by motors to control the spacing distance or the location of the roller 20 in order to adjust the tension and the level of tightness of the thin substrate 30.

In an exemplary embodiment, if desired, the exemplary embodiment of the disclosure may be structured to provide a pressure sensor 10 on any one or all of the front dual-clamping roller 721, the first upper intermediate roller 731, the first lower intermediate roller 732, the second upper intermediate roller 733, the second lower intermediate roller 734, the third upper intermediate roller 735, and the rear dual-clamping roller 741 or on a part of the roller 20 in order to timely detect abnormality of the thin substrate 30 positioned on the roller 20.

The disclosure is to provide a roller with pressure sensor and a roll-to-roll device, wherein a pressure sensor is arranged to completely wrap around a roller, so that when a thin substrate is moved on the roller, the voltage distribution of the thin substrate may be detected to identify distribution of pressure and such a voltage signal is transmitted to a controller to control a motor to adjust the roller so as to make the transferring of the thin substrate smooth and allowing to identify the pressure on the roller for adjusting rollers of each manufacturing line and making the manufacturing smooth, accurate, and efficient.

The disclosure is to provide a roller with pressure sensor and a roll-to-roll device, which may detect the distribution of pressure on a thin substrate. Compared with a known way of adopting a load cell comprising a pressure sensor that cannot detect the distribution of pressure, the embodiments of the disclosure allow for effective improvement of the transfer efficiency of the thin substrate and allow for continuously monitoring and detecting the transfer process of the thin substrate.

In summary, the embodiments of the disclosure provides a pressure sensor on a roller, which comprises for example a sheet like arrangement of an array of pressure sensing units to detect if the distribution of pressure on a thin substrate is uniform in order to improve the transfer efficiency of the thin substrate and to continuously monitor and detect the transfer process of the thin substrate. Further, with the thin substrate being moved on the roller, the voltage distribution of the thin substrate may be detected to identify the distribution of pressure. Such a voltage signal may be transmitted to a controller for controlling motors to adjust the roller. This makes the transfer of the thin substrate uniform and allows to know the roller pressure for adjusting rollers of each manufacturing line to make an entire manufacturing smooth, accurate, and efficient.

It will be apparent to those skilled in the art that various modifications and variations can be made to the disclosure. It is intended that the specification and examples be considered as exemplary embodiments only, with a scope of the disclosure being indicated by the following claims and their equivalents.

What is claimed is:

1. A roller with pressure sensor, comprising:

a pressure sensor, mounted to the roller; and wherein the pressure sensor comprises a plurality of pressure sensing units uniformly and fully distributed on a thin film and around the roller, and the plurality of pressure sensing units are electrically connected to each other but not in contact with each other, wherein the plurality of pressure sensing units are arranged in a form of a two dimensional array along the thin film, and configured to detect tensions of a plurality of locations of a thin substrate.

2. The roller with pressure sensor as claimed in claim 1, wherein the thin film comprises upper and lower layers between which the plurality of pressure sensing units and the pressure sensor is a flexible pressure sensor or a real-time pressure sensor.

3. The roller with pressure sensor as claimed in claim 1, wherein the plurality of pressure sensing units comprise a plate having a shape of a square or a rectangle, or a strip, or being arranged in an irregular way.

4. The roller with pressure sensor as claimed in claim 1, wherein the pressure sensor is mounted to a surface of the roller or is arranged inside the roller or is attached to an internal wall of the roller.

5. The roller with pressure sensor as claimed in claim 1, wherein the roller comprises a hollow structure or a non-hollow structure.

6. The roller with pressure sensor as claimed in claim 1, wherein the plurality of pressure sensing units of the pressure sensor are arranged in a form of an array and are electrically connected to each other with a metal wire, and a micro integrated circuit and a signal transmitter are arranged at one end of the pressure sensor.

7. The roller with pressure sensor as claimed in claim 1, wherein each of the plurality of pressure sensing units comprises a vibration membrane, the vibration membrane comprises a piezoelectric plate attached to a metal plate, the piezoelectric plate comprises multiple layers of piezoelectric ceramic sheets, and an alternately changed voltage is applied to the metal plate to cause the vibration membrane to curve upwards or downwards according to a change of the alternately changed voltage.

8. The roller with pressure sensor as claimed in claim 7, wherein the vibration membrane comprises one of a piezoelectric sensor, a resistive pressure sensor, and a capacitive pressure sensor.

9. A roller with pressure sensor, comprising:

a pressure sensor, mounted to the roller; and wherein the pressure sensor comprises a plurality of pressure sensing units distributed on a thin film, and the plurality of pressure sensing units are electrically connected to each other but not in contact with each other, wherein each of the plurality of pressure sensing units comprises a vibration membrane, and an alternately changed voltage is applied to the vibration membrane to cause the vibration membrane to curve upwards or downwards according to a change of the alternately changed voltage.

* * * * *